US008951058B2

(12) United States Patent
Favero et al.

(10) Patent No.: US 8,951,058 B2
(45) Date of Patent: Feb. 10, 2015

(54) ELECTRICAL CONNECTOR ASSEMBLY

(75) Inventors: Celso Eduardo Favero, Valinhos (BR); Allan Francisco Oliveira, Indaiatuba (BR); Alexandre Denadai Rugero, Americana (BR); Marcos Eduardo da Silva, Campinas (BR)

(73) Assignee: Robert Bosch Limitada, Campinas SP (BR)

( * ) Notice: Subject to any disclaimer, the term of this patent is extended or adjusted under 35 U.S.C. 154(b) by 164 days.

(21) Appl. No.: 13/810,507

(22) PCT Filed: Jul. 15, 2011

(86) PCT No.: PCT/BR2011/000226
§ 371 (c)(1),
(2), (4) Date: Aug. 27, 2013

(87) PCT Pub. No.: WO2012/006703
PCT Pub. Date: Jan. 19, 2012

(65) Prior Publication Data

US 2013/0330955 A1 Dec. 12, 2013

(30) Foreign Application Priority Data

Jul. 16, 2010 (BR) ..... 1002446

(51) Int. Cl.
*H01R 4/50* (2006.01)
*H01R 13/52* (2006.01)
*H01R 13/436* (2006.01)
*H01R 13/506* (2006.01)

(52) U.S. Cl.
CPC ..... *H01R 13/52* (2013.01); *H01R 13/436* (2013.01); *H01R 13/506* (2013.01)
USPC ..... 439/345

(58) Field of Classification Search
USPC ..... 200/345, 350, 595–599, 603, 733.1, 200/744, 746, 748, 752, 752.5, 871
See application file for complete search history.

(56) References Cited

U.S. PATENT DOCUMENTS

| | | | | |
|---|---|---|---|---|
| 4,750,893 | A * | 6/1988 | Sueyoshi et al. | 439/596 |
| 5,002,504 | A | 3/1991 | Carlson | |
| 6,159,047 | A * | 12/2000 | Tanaka | 439/595 |
| 6,183,296 | B1 * | 2/2001 | Pacini et al. | 439/577 |
| 8,662,922 | B2 * | 3/2014 | Yu et al. | 439/595 |
| 2009/0123307 | A1 | 5/2009 | Silva et al. | |

FOREIGN PATENT DOCUMENTS

| | | |
|---|---|---|
| BR | PI0603987 | 5/2008 |
| BR | MU8802744 | 9/2010 |

OTHER PUBLICATIONS

International Search Report and Written Opinion for Application No. PCT/BR2011/000226 dated Jun. 9, 2011 (9 pages).

* cited by examiner

*Primary Examiner* — Edwin A. Leon
(74) *Attorney, Agent, or Firm* — Michael Best & Friedrich LLP

(57) ABSTRACT

An electrical connector assembly includes a female part (30) having a peripheral outer wall (2) and a plurality of inner walls (3) subdividing a cavity into a plurality of reception chambers (11). An electrical contact pin (4) is housed inside each reception chamber. A locking part (20) has an accommodation (1) with a same number of inner walls (12) as the female part (30), subdividing the interior of the accommodation into a number of insulated housing chambers (13) identical to the number of reception chambers (11). An electrical terminal (10) is housed inside each of the reception chambers. A connecting cover (40) with a through-hole is attached around each electrical terminal (10), each cover having an upper portion housed inside each housing chamber (13) and a lower portion extending beyond the end of the respective housing chamber when the locking part (20) is encased inside the female part (30).

23 Claims, 6 Drawing Sheets

ELECTRICAL CONNECTOR ASSEMBLY

BACKGROUND OF THE INVENTION

The present invention refers to an electrical connector assembly particularly suitable for use in electrical connections located inside the fuel tanks of automotive vehicles of the dual fuels kind, which use different proportions of alcohol and gasoline mixtures, such as electrical fuel pumps and fuel level sensors.

Vehicles running on alcohol and/or gasoline generally comprise an electric pump responsible for pumping the fuel present in the tank to the lines that transport the fuel to the injection valves which inject fuel into the combustion motor. Besides this pump, the vehicles also use a fuel level sensor responsible for providing an electrical signal corresponding to the fuel level present in the vehicle's tank. This kind of electric pump and level sensor are powered by means of electrical cables that run through the tank, being exposed to fuel, and are connected to the electrical terminals of the pump or sensor by way of electrical connectors.

By virtue of the fact that these electrical pumps, level sensors and respective electrical power cables are in direct contact with the fuel, the connection between these and the cables needs to have some kind of sealing that prevents the entry of fuel into the electrical terminals of the pump or the sensor, especially in cases where the use of alcohol fuel is the predominating portion of the bifuel mixture.

Infiltration of fuel inside the connector is problematic due to the fact that the contact of the electrical terminals of the pump or the electrical power cables with the fuel causes chemical and/or electrolytic corrosion of same and consequently the electrical contact of the pump or of the sensor becomes prejudiced. Electrolytic corrosion, however, only occurs if two terminals with opposite polarities are exposed to the same fuel means, generating a difference in potential inside the fuel that provokes electrolysis. This corrosion is more harmful and serious than the simple contact of the electrical terminals with fuel separately.

For this kind of application of fuel pumps and level sensor, it is common to use fourway electrical connectors, having connections to the positive and negative terminals of the pump, and to the positive and negative terminals of the level sensor.

Normally, this kind of electrical connector assembly is mounted on the flange, which has a single cavity or individual cavities with electrical terminals overmolded or mounted on the flange, two of which to a pump and the other two to the level sensor. The connector assembly is formed by a locking part which has a connector molded in a single part around the four aligned pre-tinned electrical terminals. A cover is coupled over the connector to assist in sealing and protecting the electrical terminals. This cover has four cuts which are each traversed by a wire which connects to one of the terminals. Additionally, to each terminal there is connected an inner sealing ring in the junction region between the connector and the cover, to avoid infiltration of fuel directly into the terminals. The connector also has sealing rings on its outer surface which will be encased inside the female part, also to block the entry of fuel inside the connector assembly, in the region of the terminals.

When the locking part is encased into the female part, the connection between the terminals of the locking part and the connection pins of the female part occurs in the single cavity of the locking part. There is no effective physical insulation between these connections, which is extremely harmful to the quality of the electrical contacts and to the durability of the connector assembly. This is because if the fuel penetrates into the cavity, the opposite polarity electrical terminals exposed to the same fuel means will cause an electrolysis reaction, which will provoke the corrosion of these terminals.

Some electrical connector models for an environment with the presence of fuel are already known, and are designed to solve the problem of fuel infiltration in the cables, consequently reducing corrosion of the electrical terminals.

Brazilian patent document PI 0603987-1 filed in the name of Robert Bosch do Brasil refers to an electrical connector assembly for fuel pumps and level sensors for bifuel-type vehicles, which has two insulated chambers for the electrical terminals of the connector, in order to avoid corrosion by electrolysis between the two terminals caused by the difference of potential between the terminals in an environment containing alcohol. The connector assembly has inner sealing stoppers between the inner walls of the insulated chambers and the terminals, and outer sealing stoppers on the outer walls of the insulated chambers and the female connection part.

The drawback of this connector is that it provides an effective sealing only in the region of connection between the locking and female parts of the connector assembly. Additionally, it requires the use of sealing rings that are additional parts that should be manufactured separately because they are then connected to the other components of the connector assembly, which makes the process of manufacturing them more complex, and increases the expense of the end product.

In contrast, this connector assembly does not prevent the infiltration of fuel by capillarity in the cables, which is the phenomenon in which the fuel penetrates into the gap between the protective cover of the cable and the conductive metal wires and moves through this space to the terminal where the metal wires are crimped to a metal contact pin. Therefore, this fuel infiltration does not occur only in the region of coupling between the electrical contacts of the cables and the electrical device to be powered, but rather along the entire length of the cable that is in contact with the fuel in the form of vapor or liquid. This connector of the state of the art does not provide any mechanism that prevents the fuel already infiltrated into the gap between the protective cover of the cable and the metal wires from reaching the contact terminals of the cable.

The Brazilian utility model document MU8802744-9 refers to a seal-tight electrical connector assembly which prevents infiltration of fuel into the electrical terminals. The connector assembly comprises a female part having two reception chambers and two electrical contacts housed inside the female part. The connector also has a locking part with an accommodation that houses the connection ends of two electrical cables, each cable connection end being disposed inside an insulated chamber of the accommodation, the insulated chambers being encasable in a seal-tight manner into a respective reception chamber of the female part. The locking part has metal pins, the body of which presents at least a greater diameter segment than that of the opening of the insulated chambers, disposed near the connection exit opening of the accommodation, and at least an external hollow along its body to house a sealing ring. The locking part also comprises at least a sealing ring mounted by interference in each hollow of the body of the pin, making contact with pressure on the inside of a reception chamber of the female part.

In other words, this document describes the separation of the contacts of the terminals into insulated chambers, but strongly depends on various sealing rings both between the locking and females parts and on the connection pin, in order to avoid fuel infiltration. Additionally, it does not allow the simple withdrawal and substitution of insulated cables or terminals from the connector.

The Brazilian patent document PI0804605-0 refers to known transport aggregates that have a connecting lid, a connecting cover on the connecting lid, a hollow space formed between the connecting lid and the connecting cover, and electrical connections which through the connecting cover extend inwardly of the hollow space, and the electrical connections are respectively provided for in chambers separate from one another in the hollow space. The use of separate chambers for the electrical connections is to avoid completely or at least significantly diminish the corrosion that normally occurs in electrical connections and in non insulated cables, exposed to fuel, during the transport of fuels containing water, such as, for example, ethanol.

SUMMARY OF THE INVENTION

A first task of the present invention is to provide a connector for electrical connections immersed in fuel, such as those used in an electric fuel pump or fuel sensor level, resistant to exposure to fuel, with or without sealing elements, but minimizing its chemical and/or electrolytic corrosion, and consequently eliminating contact intermittences.

Another objective of the present invention is to use a single connection part easy to position and encase, with or without sealing, as well as a fast engagement and low insertion force, with reduced complexity and lesser number of parts, which also allows the substitution of cables separately and, consequently simpler and more economical.

An additional objective of the invention is to provide a connector that is overmolded on the terminal in a simple manner, with molds without the use of drawers.

Lastly, it is also an objective of the invention to provide an electrical connector assembly that allows an immediate identification of the poles of each electrical connection, and avoids inverted assembling of the cables corresponding to the pump and to the sensor and also corresponding to the polarity.

The present invention refers to an electrical connector assembly, which comprises a female part with a single cavity delimited by a peripheral outer wall, at least an inner wall subdividing this cavity into a plurality of insulated reception chambers, and an electrical contact pin housed inside each of the reception chambers.

The object of the present invention also includes a locking part with a single-part hollow accommodation with an open lower end. The accommodation comprises a same number of inner walls as the female part, subdividing the hollow interior of the accommodation in a number of insulated housing chambers in an identical number to the reception chambers of the female part. It also includes an electrical terminal housed inside each of the reception chambers. The locking part is encasable through its lower end inside the female part, with each housing chamber of the locking part being aligned with a reception chamber of the female part forming an insulated environment. Each electrical terminal of the locking part connects to an insulated environment with a respective electrical contact pin of the female part.

Each inner wall of the female part extends to a height lower than the height of the peripheral outer wall.

The locking part comprises a connecting cover with a through-hole being attached around each electrical terminal. Each cover has an upper portion housed inside each housing chamber and a lower portion extends beyond the end of the respective housing chamber. When the locking part is encased inside the female part, a lower portion of the connecting cover is housed inside the reception chamber of the female part, and extends over the terminal connection of the locking part with the electrical contact pin of the female part.

BRIEF DESCRIPTION OF THE DRAWINGS

The present invention will now be described in greater detail based on an embodiment represented in the drawings. The drawings show.

DETAILED DESCRIPTION

Figure 1:
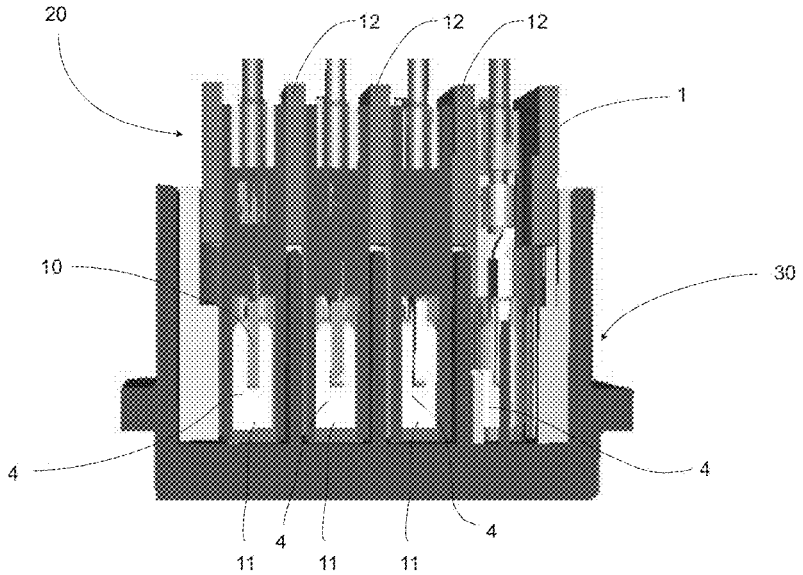
FIG. 1 is a cross-sectional view of a first embodiment of the electrical connector assembly according to the present invention, with all the parts assembled.

As can be seen in FIG. 1, the first embodiment of the electrical connector assembly of the present invention shown in cut perspective comprises a female part 30 and 20 a locking part 20 having a smaller external or identical diameter to the female part. The locking part may be disposed on the female part, when both have the same diameter, or may fit inside the female part, when it has a diameter smaller than the latter. A plurality of electrical terminals 10 are at least partially housed inside the locking part 20 and fit together establishing an electrical contact with the electrical contact pins 4 of the female part 30, in the form of a male-female connection, establishing an electrical connection of the connector assembly.

Figure 2:
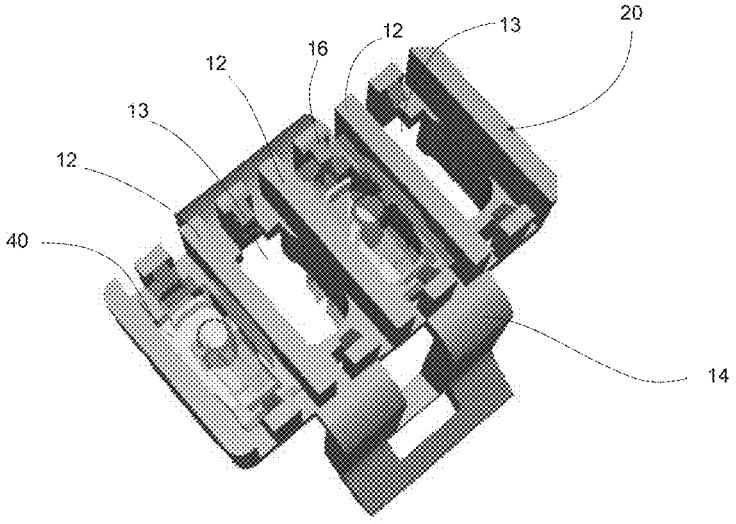
FIG. 2 is an upper perspective view of the locking part of the electrical connector assembly illustrated in FIG. 1 having two protective covers.

FIG. 2 shows in detail the locking part 20 disengaged from the female part 30. The female part 30 comprises a single cavity delimited by a peripheral outer wall 2. The female part 30 also has at least an inner wall 3 subdividing its cavity into a plurality of separated reception chambers 11. In the first embodiment, three inner walls 3 are used to subdivide the cavity into four reception chambers 11. This is because the connector assembly illustrated in this embodiment is applicable to four-way electrical connectors, for example, two of which are destined to receive the positive and negative terminals of a fuel pump and two are destined to receive the positive and negative terminals of the fuel level sensor inside the vehicle's tank. However, this same connector according to any of the embodiments of the present invention can be used for applications that use just two terminals, or also for other applications that use more than four terminals, and being associated to other electrical devices that should normally be exposed to an environment with fuel. Accordingly, the inner cavity of the female part 30 should be subdivided in as many reception chambers 11 as necessary to accommodate the terminals of the electrical devices used.

The female part 30 also has a plurality of electrical contact pins 4, one pin for each electrical connection that will be formed in the connector assembly. Each contact pin 4 is housed inside a separate reception chamber 11. The contact pins 4 of the female part 30 act as a male terminal of the electrical connection formed inside the connector assembly.

The locking part 20 is shown in further detail in FIG. 2. This part is preferably made of polyoxymethylene (POM), and has a hollow accommodation 1 formed in a single part that will be encased into the female part 30. The lower end of this accommodation is open, in the region where the electrical contact of the female part 30 with the locking part 20 occurs. The hollow insides of the accommodation also comprises inner walls 12 in the same quantity as the inner walls 3 of the female part 30, subdividing the hollow insides of the accommodation 1 into a number of separated housing chambers 13 identical to the number of reception chambers 11 of the female part. In the first embodiment of the invention shown in FIG. 2, the accommodation has three inner walls 12 subdividing the hollow insides of the accommodation 1 into four housing chambers 13 coincidentally with the female part 30 shown in FIG. 5.

The locking part 20 also has an electrical terminal 10 at least partially housed inside each one of the housing chambers 13. Therefore, in the present case, the locking part 20 has four electrical terminals 10, each one being encased inside a housing chamber 13. These electrical terminals 10 of the locking part 20 are female-type terminals that will couple to the contact pins 4 (male terminals) of the female part 30. Both the electrical terminals 10 of the locking part 20 and the contact pins 4 of the female part 30 are coated in a metal bath, for example, tin or nickel, which increases the component's resistance to corrosion. Additionally, the shape of the terminals and pins allows the process of surface coating to be applied after the process of stamping used in the manufacture thereof. The terminals are fixed to the electrical cables of the electrical device to be connected to the connector assembly by a spot welding process, by ultrasound welding or mechanical cramping.

When the locking part 20 is encased inside the female part 30, its open lower end is housed inside the cavity of the female part 30, such that each housing chamber 13 of the locking part 20 is aligned with a reception chamber 11 of the female part 30, forming an insulated environment, as can be seen in FIG. 1. Preferably, each inner wall 12 of the locking part 20 bears against the respective inner wall 3 of the female part 30, defining an insulated environment. In the first embodiment of the invention illustrated in FIGS. 1 to 5, four insulated environments are formed inside the electrical connector assembly. Accordingly, each electrical terminal 10 of the locking part 20 connects to a respective electrical contact pin 4 of the female part 30 in one of the insulated environments. It is thus possible to avoid the presence of two pins or electrical terminals having different polarities inside a same environment with fuel, which is what causes electrolysis and, consequently, the corrosion of the pins and terminals.

Additionally, this alignment between the housing chamber 13 of the locking part 20 and the reception chamber 11 of the female part 30 enables the guided mounting of the locking part 20 inside the female part 30, whereby ensuring the necessary alignment for the correct insertion of the electrical contact pin 4 of the female part in the terminal 10. Another advantage of the disposition of the various connection terminals 10 in a same locking part 20 already duly aligned with the contact pins 4 of the respective female part 30 is that this enables the locking part 20 to be mounted on the female part 30 in a single movement with low insertion force, coupling the four terminals in one go.

Figure 5:
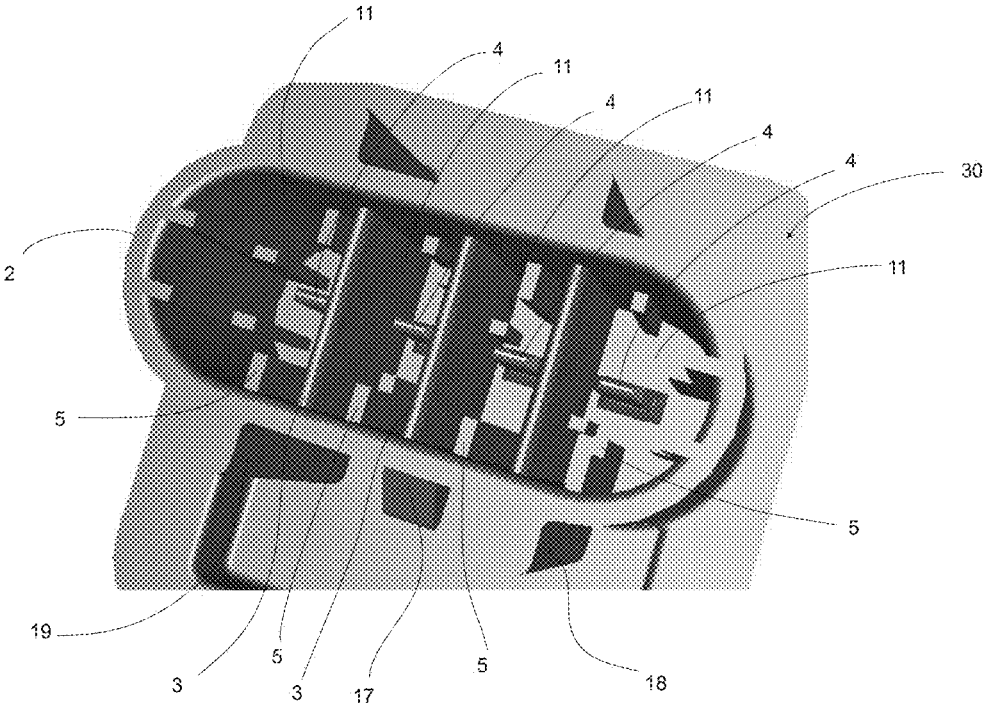
FIG. 5 is an upper view of the female part according to the first embodiment of the invention.

As can be seen clearly in FIGS. 2 and 5, each inner wall 3 of the female part 30 extends to a lower height than the height of the peripheral outer wall 2. This allows the lower part of the accommodation of the locking part 20 to be completely housed inside the cavity of the female part 30, surrounded by the peripheral outer wall 2 of the female part 30. Otherwise, the top of the inner walls 12 of the locking part 20 might hit the inner walls 3 of the female part 30, preventing a stable coupling between the male and female parts of the connector assembly.

Figure 3:
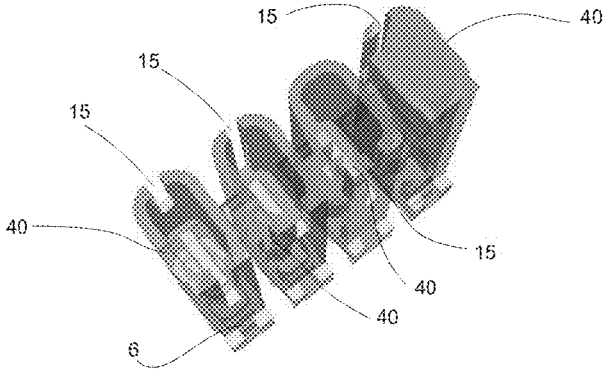
FIG. 3 is an upper perspective view of the connecting covers of the electrical connector assembly illustrated in FIG. 1.
Figure 6:
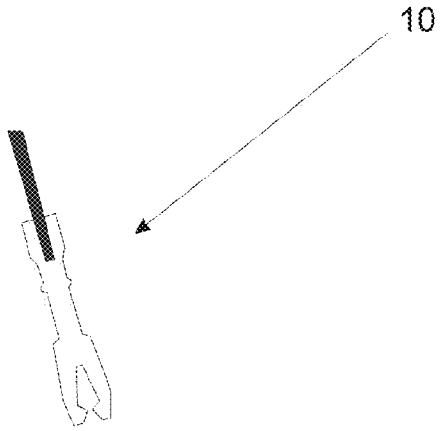
FIG. 6 is a view of a cable welded to a terminal used in the electrical connector assembly according to the present invention.

FIG. 3 illustrates in detail the connecting covers 40 which make up the connector assembly of the present invention. These connecting covers are independent parts, preferably made of polyoxymethylene (POM). They have a hollow interior traversed by a through-hole, and are connected by means of this through-hole around each electrical terminal 10 (for example of the type shown in FIG. 6) which is encased in the locking part 20. The covers 40 and the terminals 10 have a greater length than the length of the accommodation cavities 13 of the locking part 20, and the cover preferably wraps the entire length of the terminal. When the terminals 10 with the respective covers 40 are encased in the locking part 20, each terminal with a cover has its upper portion housed inside a housing chamber 13. Therefore, in the first embodiment of the present invention illustrated in FIGS. 1 to 5, there is provided four covers 40, each having its upper portion disposed inside one of the housing chambers 13 of the locking part 20. The lower portion of the covers 40 and of the terminals 10 extends beyond the lower end of the respective housing chamber, such that when the locking part 20 is encased inside the female part 30, the lower portion of the connecting covers 40 and of the terminals 10 is then housed inside the reception chamber 11 of the female part 30. The terminal 10 connects to the electrical contact pin 4 of the female part 30, and the cover 40 extends over the connection of the contact pin with the terminal, this connection becoming completely housed. The connecting cover 40 can be overmolded on its respective terminal 10.

As can be seen in FIGS. 1 and 3, each housing chamber 13 of the locking part has an opening at the upper end of the accommodation, through which the connecting cover 40 and the respective terminal 10, which are housed in the housing chamber, are inserted into and withdrawn from the locking part 20. This allows each cable or electrical terminal to be substituted individually and easily, without needing to substitute the other cables and electrical terminals of the devices connected to the electrical connector assembly. To disengage the assembly from the terminal 10, it is suffice to pull out the cover of the connector pin 4 from the accommodation of the locking part 20 manually.

The connecting covers 40 should be firmly encased inside the reception chamber 11 and the housing chamber 13 and around the pins 4 and terminals 10 in order to avoid vibrations that cause electrical contact problems. Accordingly, the connecting covers 40 have an external shape compatible with the internal shape of the housing chamber 20 and of the reception chamber, such that when the connecting cover 40 is housed inside the housing chamber 13 and the reception chamber 11, it exerts an interference pressure on the inner surface of the housing chamber 13 and of the reception chamber 11.

Alternatively, instead of being overmolded to the terminal 10, the cover 40 can be encased thereover. In any case, the through-hole of the connecting cover 40 has an inner diameter in the upper portion which is compatible with the external diameter of the terminal 10 of the locking part 20, such that it is encased with interference pressure inside the cover, preventing the entry of fuel. In the lower portion of the cover 40, its inner diameter should be compatible with the coupling between the terminal 10 and the contact pin 4, such that when there is coupling between the terminal 10 and the pin 4 inside the insulated environment, the terminal 10 of the locking part 20 and the electrical contact pin 4 of the female part 30 are housed inside the through-hole of the connecting cover 40, exerting an interference pressure on the inner profile of the locking part (20) of the through-hole.

As can be seen in FIG. 1 which illustrates a cross sectional view of the connector assembly in its assembled state, the inner structure formed first by the coupling of the accommodation of the locking part 20 inside the peripheral outer wall 2 of the female part 30, next through the inner walls 3 and 12 of the female part 30 and of the locking part 20 forming insulated environments, and then by the connecting covers 40 provides a series of barriers from the external environment of the connector assembly up to the connection of the terminals with the pins. This series of barriers forms a kind of labyrinth that should be traversed by the fuel outside the connector assembly, significantly hampering the arrival of the fuel to the connections of the terminals with the contact pins. This allows the connector assembly to be exposed in liquid or vapor fuel, without the need for sealing rings or other parts and additional sealing structures disposed in the connection regions between the locking and female parts. Additionally, even if the fuel penetrates inside the connector assembly, the use of insulated environments formed by the reception 11 and accommodation 13 chambers for each terminal and pin prevents that two terminals/pins having opposite polarities are exposed to the same fuel environment causing electrolysis. Accordingly, the structure of the connector assembly according to the invention provides two-fold protection against corrosions of electrical terminals and contact pins.

To guarantee correct coupling between the electrical cables of the devices connected to the connector assembly (for example, injection pump or level sensor) and the respective connection pins in the female part, each of the reception chambers 11 of the female part 30 comprises on the bottom an encasement means 5 with specific shape for the connecting cover 40, and the connecting covers comprise lower encasement means 15 at their lower end with complementary shape to the encasement means 5 of their respective reception chamber 11. This kind of specific encasement is also called poka-yoke. As each cover 40 will have a specific lower encasement means 15 which is only compatible with the encasement means of its respective reception chamber 11, this prevents an electrical cable or electrical terminal from being encased with the wrong contact pin.

Figure 4:
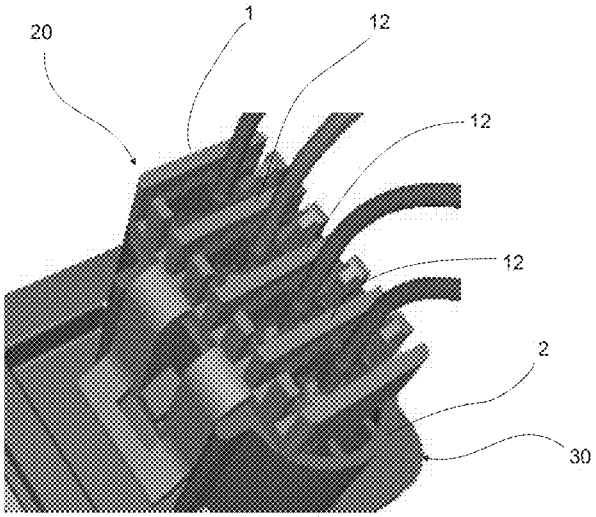
FIG. 4 is an upper perspective view of the electrical connector assembly according to the first embodiment of the invention, illustrating the locking part connected to the female part, and the connecting covers located inside the locking part.

Additionally, the housing chambers 13 have an inner shape in cross section which is asymmetrical. In the same way, the connecting covers 40 also have an outer shape in cross section with the same asymmetrical shape as the housing chambers 13. Accordingly, the covers 40 can only be inserted into the housing chambers 13 in a single specific position, in order to avoid inverted mounted of the cover and of the terminal of the connector assembly in the locking part 20. In the embodiment of the invention shown in FIG. 3, one side of the housing chamber has a rounded profile and the other side 15 has a flat profile. As can be seen in FIG. 4, the connecting covers 40 accompany this same rounded shape on the one side and flat on the other, which requires that they be inserted into the housing chamber 13 always in the correct direction, whereby forming a second poka-yoke of the electrical connector assembly of the present invention.

The locking part 20 also has an outer locking means 14 to enable its encasement lockingly over the peripheral outer wall 2 of the female part 30 in a single coupling direction of the locking part 20 with the female part 30, and also providing better fastening between the two parts. In the embodiment of the invention illustrated in FIGS. 2, 4 and 5, these outer locking means of the locking part are a clamp 14 which extends from one of the side peripheral edges of the accommodation 1 of the locking part 20, extending downwards, in parallel to the outer wall of the accommodation. This clamp 14 has a cutout in its central part, to assist in fastening and enable the coupling in the right direction between the two parts of the connector assembly. The female part 30, in contrast, has external encasement means 17, 18, 19 in the form of projections molded on the outer face of the peripheral outer wall 2, which have a shape and specific relative spacing that enables the engagement of the clamp 14 of the locking part 20 only on that face of the female part 30, indicating the correct encasement direction. When both parts are encased, the clamp 14 thereafter extends over the peripheral outer wall 2 of the female part 30, pressuring-it, and the projection 17 located in the center of the outer face of the peripheral wall encases in the central cutout of the clamp 14. Additionally, the clamp 14 remains encased between the left 19 and right 18 side projections.

The locking part 20 also has two guides 50 which extend parallel in relation to each other from the peripheral edge of the accommodation 1, on the opposite side of the clamp 14, and have an inner channel. When the locking part is connected on the female part 30, the guides 50 are attached two vertical tracks 51 which extend over the outer peripheral wall 2 of the female part, on the opposite side of the outer encasement means 17, 18, 19. Hence, the locking part 20 and the female part are attached by their two sides.

This interaction of the outer encasement means 17, 18, 19 and the guides 50 of the female part with the clasp 14 and the two tracks 51 of the locking part 20 enables the two parts 20, 30 to be attached and aligned together in a stable manner, without the locking part 20 having to fit inside the female part 30. Additionally, this disposition ensures that the locking part will always be mounted on the female part in a correctly guided manner.

A second embodiment of the invention is shown in FIGS. 7 to 12. In this embodiment, instead of using connecting covers in the form of separate components, the terminals are directly overmolded with a polymer material, forming a connecting cover in the region in which the respective cables are welded, forming the male parts 60 which will be encased inside the reception chambers 11 of the female part 30 and of the housing chambers 13 of the locking part 20. Just as in first embodiment, each overmolded terminal 60 is inserted and withdrawn from the male part 20 by way of the opening in the upper end of each housing chamber of the male part 20.

Figure 7:
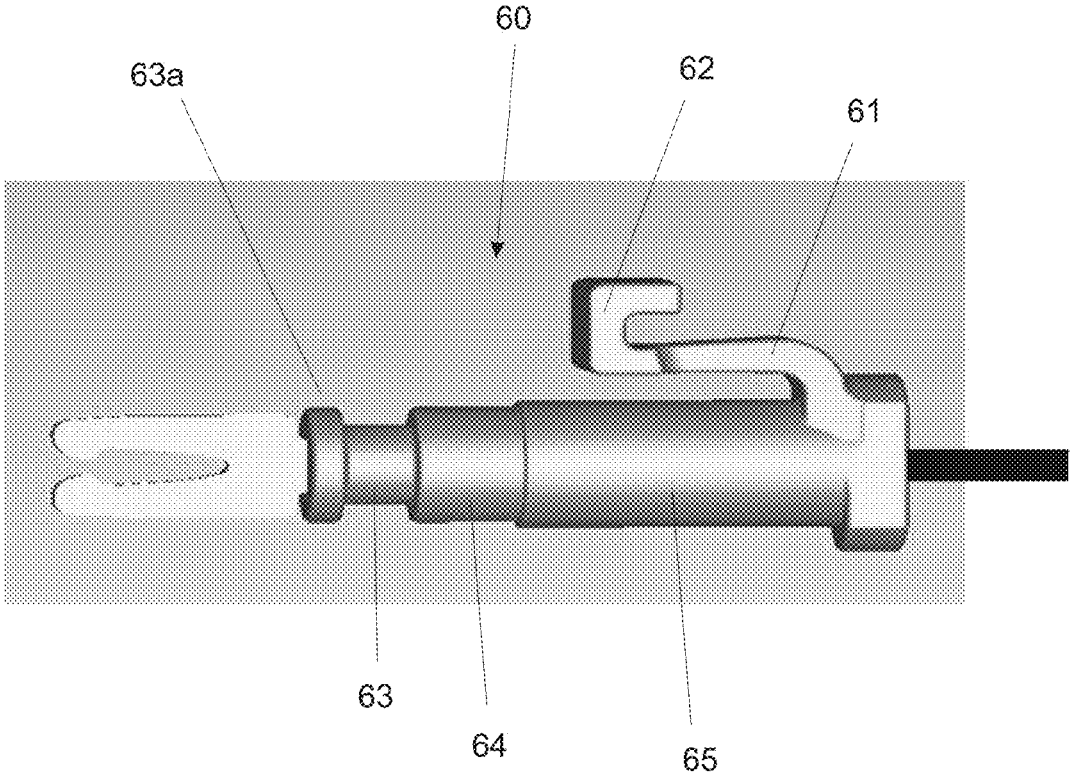
FIG. 7 is a side view of a terminal overmolded used in a second embodiment of the electrical connector assembly according to the present invention.
Figure 8:
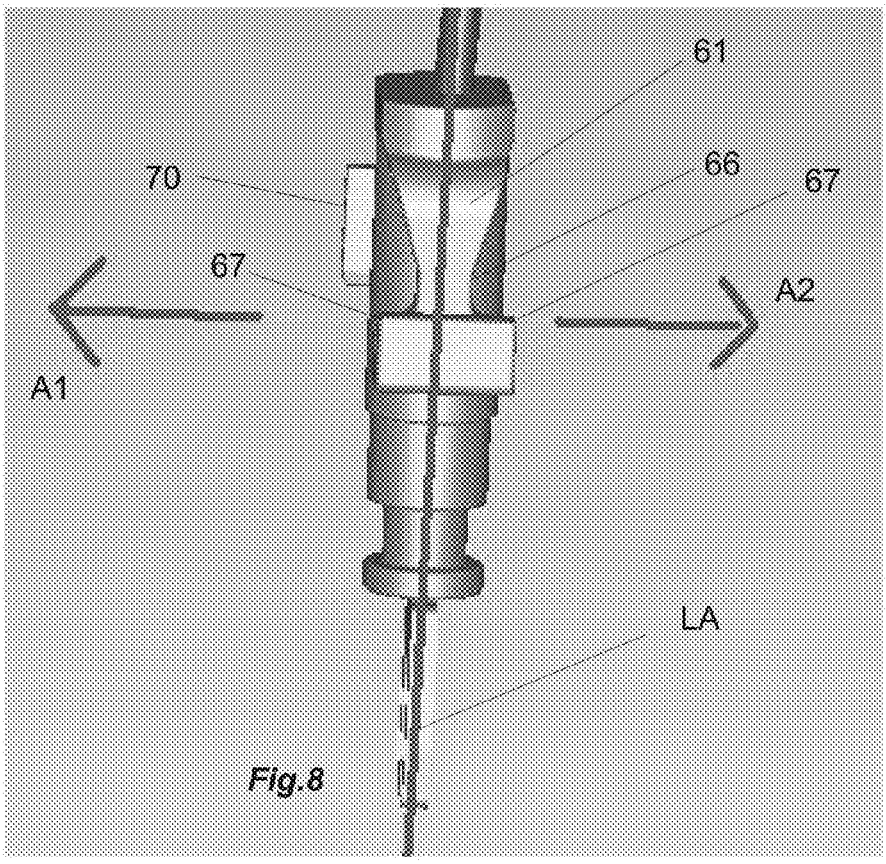
FIG. 8 is a front view of the overmolded terminal of FIG. 7, with arrows indicated the direction of the welding tool opening.
Figure 9:
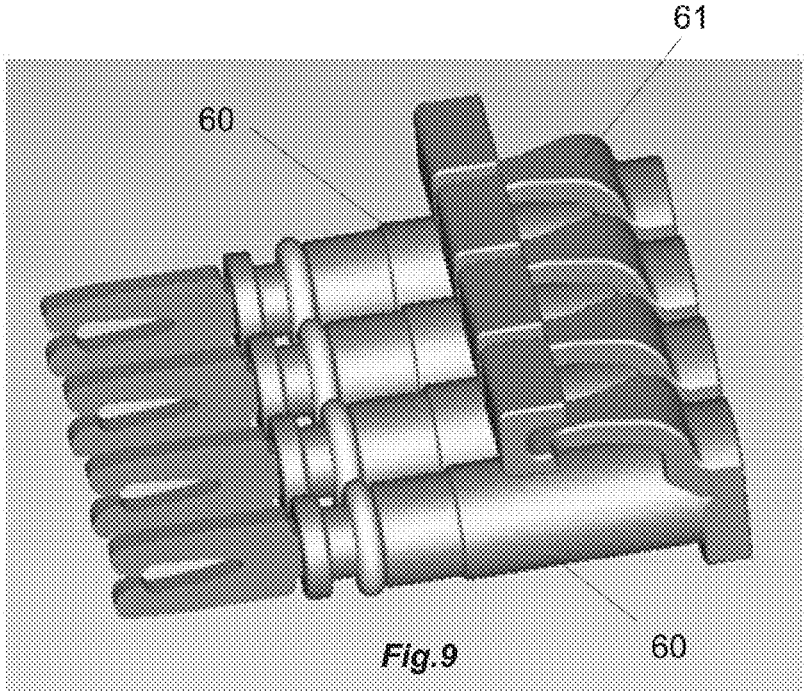
FIG. 9 is a perspective view of four overmolded terminals used in the connector assembly according to the second embodiment of the invention.
Figure 11:
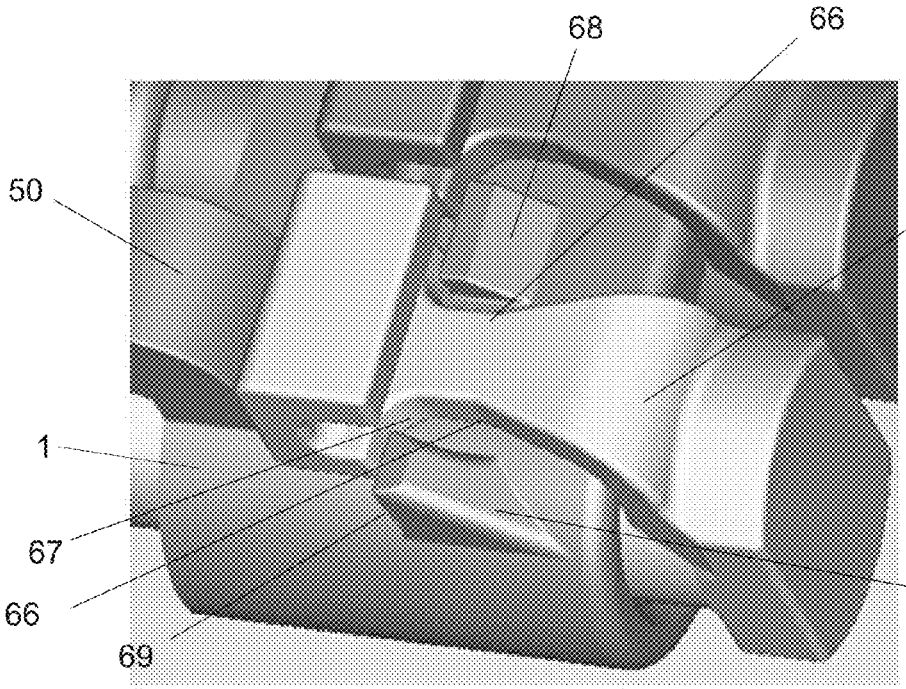
FIG. 11 is a view of a detail of the locking between the electrical terminals and the locking part according to the second embodiment of the invention.

As can be seen in greater detail in FIGS. 7 to 9, each overmolded terminal 60 has a locking leg 61 which extends from the upper portion of the body of the terminal 60 and in parallel thereto. Hence, when the overmolded terminal 60 is encased into the locking part 20, the locking leg extends over the housing 1 of the locking part 20, lockingly coupling onto the locking part. This coupling can be by snap fit, just like a clip. As can be seen in FIG. 11, the locking legs have a stricture 66 followed by a widened and flat lower section 67 which serves to lock the terminal 60 to the locking part, as described more clearly ahead. At the lower end 62 of the locking leg 61, after the widened and flat lower section 67, there is formed a U-profile fold, which serves to assist the disengagement from the terminal of the female part 30 and the locking part 20. This folded lower end 62 forms a greater area region that can easily be pushed upwards by the user with a finger.

The overmolded terminals 60 have an outer format compatible with the inner format of the housing chamber 13 and the reception chamber 11, and when the overmolded terminals 60 are connected inside the housing chamber 13 and the reception chamber 11, they exert an interference pressure on the inner surface of the housing chamber and of the reception chamber. The body of the overmolded terminal 60 has a cylindrical format with a wider upper edge, from which the cable extends, and a lower edge 63A from which the contact of the electrical terminal extends. The cylindrical body of the overmolded terminal 60 is divided into regions with different diameters. The upper region 65 has a greater diameter and larger length. The average region 64 has a smaller diameter than the upper region. The lower region 63 has a smaller diameter than the middle region 64, and also smaller than the lower edge 63A, whereby forming a kind of undercut. At least one O-sealing ring can be connected in this undercut. However, the connector of the present invention working equally without a sealing ring. Alternatively, sealing rings may be applied only to certain chosen terminals.

When an overmolded terminal 60 is connected inside the female 30 and locking 20 parts, the upper region 65 is housed inside the housing chamber 13 of the locking part 20, and the middle 64 and lower 63 regions are housed inside the reception chamber 11 of the female part 30.

Figure 10:
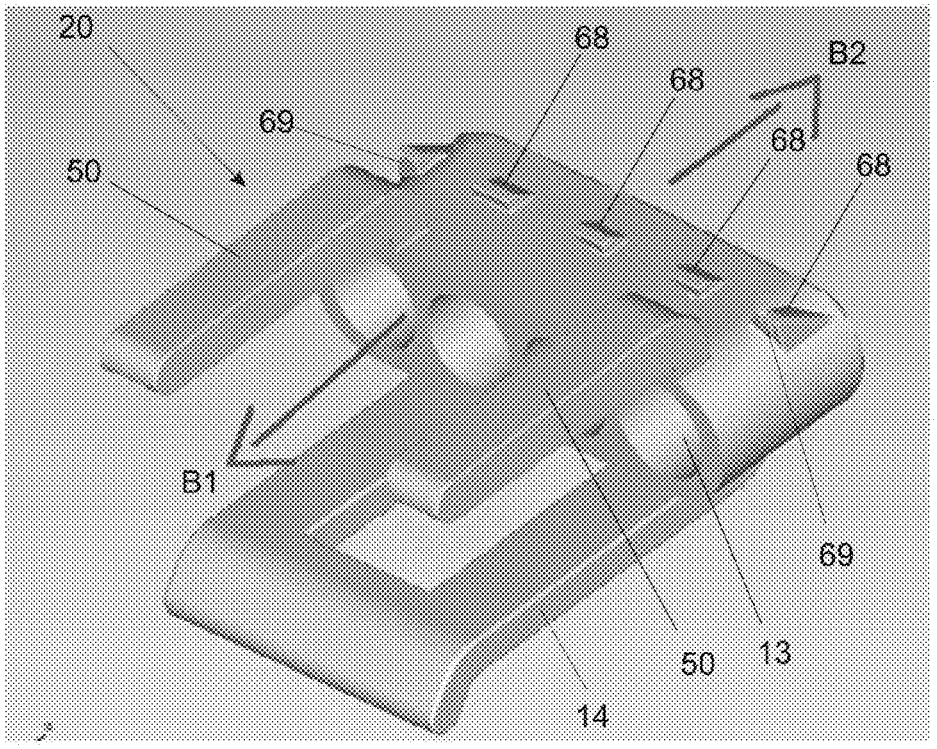
FIG. 10 is a perspective view of the locking part according to the second embodiment of the invention.

The locking part 20 according to this second embodiment of the invention has a format similar to that of the first embodiment, but has certain additional characteristics. As illustrated in FIGS. 10 and 11, on its outer periphery, locking means 68 are molded in the form of shoulders, among which the strictures 66 of the locking legs 61 of the overmolded terminals 60 are fitted, when they are inserted into the locking part 20. In this embodiment shown in FIG. 10, the locking means 68 have an approximately triangular cross section, with a straight base 69 destined to oppose as stanchions to the flat lower section 67 of the stricture, when the two parts are encased, as can be seen in FIG. 11.

The locking means 68 are formed in the region of the outer periphery of the locking part which is opposite the clasp 14. Preferably, these locking means 68 are formed on the same side as the guides 50 of the locking part, being located above these guides. Accordingly, when the overmolded terminals are connected to the locking part 20, the locking legs 61 can only be engaged on the side of the locking means 68 and the guides 20, helping to guide the assembly of the terminals correctly.

Figure 12:
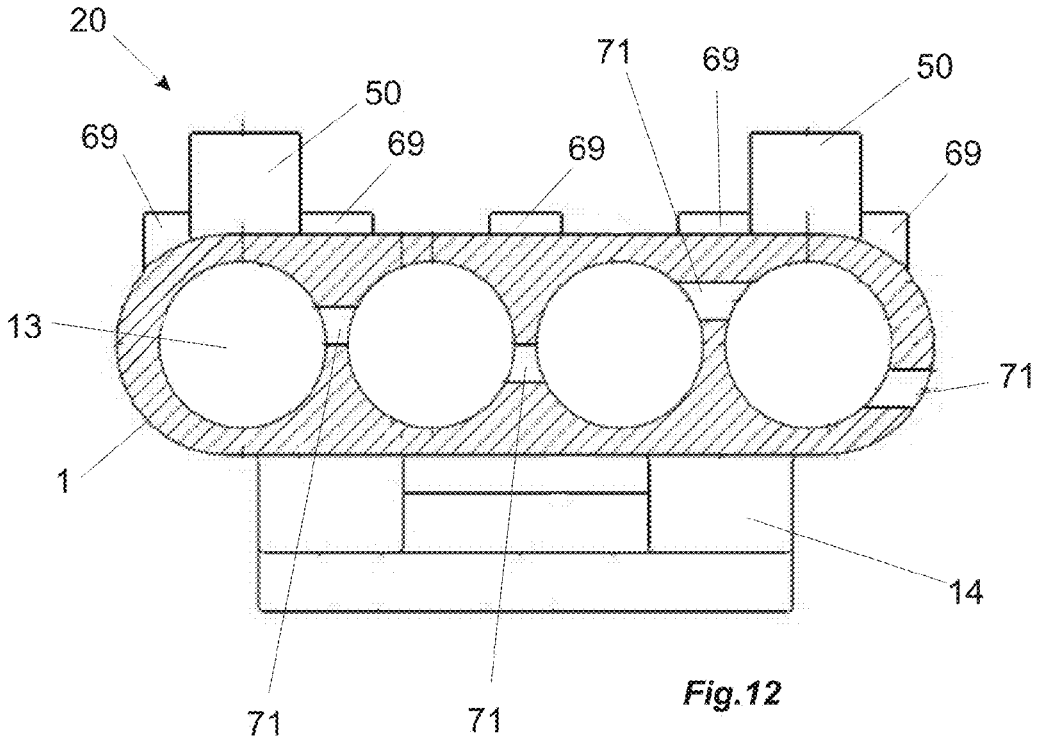
FIG. 12 is an overhead view of the locking part, showing the poka-yokes for the overmolded terminals.
Figure 13:
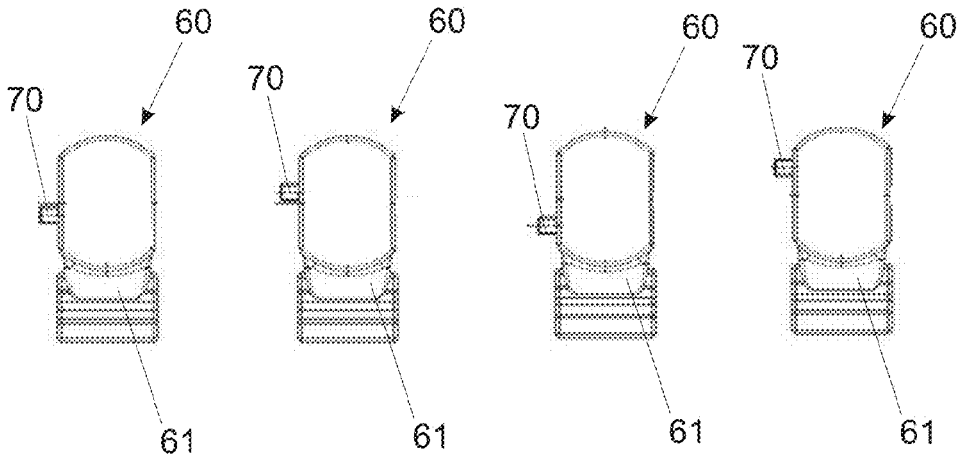
FIG. 13 is an overhead view of the overmolded terminals showing the poka-yokes for coupling with the locking part.

Additionally, as shown in FIGS. 12 and 13, the overmolded terminals 60 and the locking part 20 according to this second embodiment of the invention also have a poka-yoke which determines in which housing chamber 13 of the locking part 20 each of the terminals should be inserted, for correct connection with its respective contact located in the female part 30. Each of the overmolded terminals 60 has a flange 70 protruding from the upper region 65 of its body, the flange 70 being shorter than the upper portion of the 65 of the body. However, in each of the four terminals, the flange 70 protrudes from a different point of the circumference of the body, as shown in FIG. 13, which shows an overhead view of each of the terminals. Each one of the housing chambers 13 of the locking part 20, in turn, has a cutting 71 in the wall, which is located in a position of the chamber coinciding with the position of the flange 70 of the overmolded terminal 60 destined for that chamber, when encased inside. The cutting has have the same length and width as its respective flange 70.

Accordingly, each terminal being guided by the locking leg 61 to the correct side, that is, facing the side of the locking part where the locking means 68 are, then each overmolded terminal 60 can only be encased in the chamber 13 of the locking part 20 associated thereto. If an attempt is made to fit an overmolded terminal 60 into a wrong chamber, the flange 70 will bump into the edge of the locking part 20 and will prevent its passage.

The simple formats of the locking part 20 and the overmolded terminals 60 allow both to be produced by molding tools without drawers, which simplifies and reduces the costs of its respective production processes. In FIG. 8, arrows A1 and A2 point in the opening direction of the molding tool of the overmolded terminal and line LA corresponds to the closing line of the tool. In FIG. 10, arrows B1 and B2 correspond to the opening directions of the molding tool of the locking part 20. As also can be seen in FIG. 10, the position relating to the locking means 68 in relation to the guides 50 of the locking part 20 enable the latter to be produced by mold without drawer.

In this second embodiment of the invention, each overmolded terminal 60 is connected to the locking part 20 by just one side, by way of its locking leg 61, making encasement and detachment simple and easy. Replacing any of the parts of the connector is also quite simple. Simply detach it from the other components and replace it. Such replacement will not harm the rest of the connector assembly.

In any of the embodiments of the invention, the construction of the connector assembly of the present invention using four ways aligned in a same part means it is possible to alternate the sequence of the polarities of the terminals, for example, placing the positive and negative terminals of the level sensor and then the positive and negative fuel pump terminals respectively.

The invention claimed is:

1. An electrical connector assembly, comprising:

a female part (30) comprising a peripheral outer wall (2), an upper open end and a plurality of insulated inner reception chambers (11) separated by at least an inner wall (3), with an electrical contact (4) at least partially housed inside each of the reception chambers, a locking part (20) having an accommodation (1) with an open lower end, the accommodation comprising a number of insulated housing chambers (13) identical to the number of reception chambers (11) of the female part, the insulated chambers being separated by at least an inner wall (12), the locking part (20) being attachable through its lower end on the female part (30), with each housing chamber (13) of the locking part being aligned with a reception chamber (11) of the female part forming an insulated environment, at least an electrical terminal (10), each electric terminal (10) being attachable to the inside of a housing chamber (13) of the locking part (20), and being connectable, in an insulated environment, to a respective electrical contact pin (4) in a reception chamber (11) of the female part, characterized in that, a connecting cover (4) with a through-hole is attached around each electric terminal (10), each cover having an upper portion encased inside a housing chamber (13) and a lower portion extending beyond the end of the respective housing chamber, and in the connected position of the locking part (20) with the female part (30), the lower portion of the connecting cover (40) is encased inside the respective reception chamber (11) of the female part, and extends over the electrical contact pin (4) of the female part (30).

2. The electrical connector assembly according to claim 1, characterized in that each housing chamber (13) of the locking part (20) has an opening at an upper end of the locking part (30), through which the connecting cover (40) and the respective terminal (10) housed in the respective housing chamber are inserted and withdrawn from the locking part (20).

3. The electrical connector assembly according to claim 1, characterized in that the connecting cover (40) has an external format compatible with an inner format of the housing chamber (13) and the reception chamber (11), and when the connecting cover (40) is encased inside the housing chamber (13) and the reception chamber (11), it exerts an interference pressure on an inner surface of the housing chamber and the reception chamber.

4. The electrical connector assembly according claim 1, characterized in that the through-hole of the connecting cover (40) has an inner diameter, in the upper portion, compatible with an outer diameter of the terminal (10) of the locking part (20) and in the lower portion, compatible with a coupling between the terminal (10) and the contact pin (4), and when the terminal (10) of the locking part and the electrical contact pin (4) of the female part (30) are housed in the through-hole of the connecting cover (40), they exert an interference pressure on an inner surface of the through-hole.

5. The electrical connector assembly according to claim 1, characterized in that the connecting covers (40) are made of POM.

6. The electrical connector assembly according to claim 1, characterized in that each of the reception chambers (11) comprises an encasement means (5) with a specific format for a connecting cover, and the connecting covers (40) comprise lower encasement means (15) on their lower end with a complementary format to the respective encasement means (5) of the reception chamber.

7. The electrical connector assembly according to claim 1, characterized in that the housing chambers (13) of the locking part (20) have an inner cross-section with asymmetrical format, and the covers (40) also have an outer cross-section with this same asymmetrical format, and the covers (40) are encasable within the respective housing chambers in a single orientation.

8. An electrical connector assembly, comprising:

a female part (30) comprising a peripheral outer wall (2), an open upper end and a plurality of insulated inner reception chambers (11) separated by at least an inner wall (3), with an electrical contact pin (4) at least partially housed inside each of the reception chambers, a locking part (20) having an accommodation (1) with an open lower end, the accommodation comprising internally a number of insulated housing chambers (13) equal to the number of reception chambers (11) of the female part, the insulated chambers being separated by at least an inner wall (12), a locking part (20) being attachable through their lower end on the female part (30), with each housing chamber (13) of the locking part being aligned with a reception chamber (11) of the female part forming an insulated environment, at least an electrical terminal (10), each electrical terminal (10) being attachable to the inside of a housing chamber (13) of the locking part (20), and being attachable in an insulated environment with a respective electrical contact pin (4) in a reception chamber (11) of the female part, characterized in that, each electrical terminal (10) is overmolded with a connecting cover forming an overmolded terminal (60) having a locking leg (61) which extends from the body of the terminal (60) and lockingly connects on the accommodation (1) of the locking part (20).

9. The electrical connector assembly according to claim 8, characterized in that each housing chamber (13) of the male part (20) has an opening at the upper end of the male part (20), through which the respective overmolded terminal (60) is inserted and withdrawn from the male part (20).

10. The electrical connector assembly according to claim 8, characterized in that the locking leg (61) extends from an upper portion of the body of the terminal (60) and in parallel thereto, and has a stricture (66) followed by a widened and flat lower section (67).

11. The electrical connector assembly according to claim 10, characterized in that the locking leg (61) has a U-profile fold at its lower end (62), after the widened and flat lower section (67).

12. The electrical connector assembly according to claim 10, characterized in that the locking part (20) has a plurality of molded locking means (68) protruding from its outer periphery, among which the strictures (66) are encased, and which oppose the widened and flat lower section (67) of the locking legs (61) of the overmolded terminals (60).

13. The electrical connector assembly according to claim 8, characterized in that the overmolded terminals (60) have an outer format compatible with an inner format of the housing chamber (13) and of the reception chamber (11), and when the overmolded terminals (60) are attached inside the housing chamber (13) and the reception chamber (11), they exert an interference pressure on an inner surface of the housing chamber and the reception chamber.

14. The electrical connector assembly according to claim 8, characterized in that the overmolded terminals (60) have a cylindrical format with an upper region superior (65) larger in diameter, a middle region (64) smaller in diameter than the upper region and a lower region (63) smaller in diameter than the middle region (64), and smaller than an inner edge (63A), the lower region (63) forming an undercut accommodating at least a sealing ring (64), and the upper region (65) is housed inside the housing chamber (13) of the locking part (20), and the middle (64) and lower (63) regions are housed inside the reception chamber (11) of the female part (30).

15. The electrical connector assembly according to claim 8, characterized in that, the housing chambers (13) of the locking part (20) each have a cutting (71) on their wall, and in each of the housing chambers (13), the cutting is located in a different position on a circumference of the chamber, and each overmolded terminal (60) has a flange (70) protruding from its body, for encasement in a cutting (71) of a housing chamber (13) of the locking part (20), and in each terminal, the flange (70) protrudes from a different point of the circumference of the body, which coincides with the position of the cutting (71) of only one respective one of the housing chamber (13).

16. The electrical connector assembly according to claim 8, characterized in that the overmolded terminal (60) and the locking part (20) have a format that can be produced by a tool without drawer.

17. The electrical connector assembly according to claim 1, characterized in that when the locking part (20) is attached on the female part (30), each of the inner walls (12) of the locking part leans against a respective inner wall (3) of the female part (30) delimiting an insulated environment inside of which a terminal (10) of the locking part (20) connects to an electrical contact pin (4) of the female part (30).

18. The electrical connector assembly according to claim 1, characterized in that the electrical terminals (10) are coated in a metal bath selected from tin and nickel.

19. The electrical connector assembly according to claim 1, characterized in that the locking part (20) is made of POM.

20. The electrical connector assembly according to claim 1, characterized in that the locking part (20) comprises an outer clasp (14) which lockingly encases on the peripheral outer wall (2) of the female part (30) in a single connecting orientation of the locking part (20) with the female part (30).

21. The electrical connector assembly according to claim 20, characterized in that the locking part (20) has two guides (50) extending from the lower peripheral edge of the accommodation (1), on the opposite side of the clasp (14), and have an inner channel.

22. The electrical connector assembly according to claim 21, characterized in that the locking means (68) are formed above the guides (50), and on a side of the outer periphery of the locking part (20) opposite the clasp (14).

23. The electrical connector assembly according to claim 1, characterized in that the locking part (20) has at least two housing chambers (13) and the female part (30) comprises at least two reception chambers (13).

* * * * *